US007570776B2

(12) United States Patent
Watanabe

(10) Patent No.: US 7,570,776 B2
(45) Date of Patent: Aug. 4, 2009

(54) SPEAKER DEVICE AND METHOD OF MANUFACTURING THE SPEAKER DEVICE

(75) Inventor: Tomoyuki Watanabe, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 688 days.

(21) Appl. No.: 11/083,990

(22) Filed: Mar. 21, 2005

(65) Prior Publication Data

US 2006/0120554 A1 Jun. 8, 2006

(30) Foreign Application Priority Data

Mar. 19, 2004 (JP) ..... 2004-080144

(51) Int. Cl.
*H04R 25/00* (2006.01)

(52) U.S. Cl. ..... 381/353; 381/403; 381/404

(58) Field of Classification Search ..... 381/403, 381/404, 405, 407, 398, 423, 424, 412, 409, 381/410; 181/171, 172
See application file for complete search history.

(56) References Cited

U.S. PATENT DOCUMENTS 6,088,466 A * 7/2000 Proni ..... 381/397
6,672,423 B2 * 1/2004 Kato ..... 181/161
2003/0063769 A1 * 4/2003 Ando et al. ..... 381/423
2005/0111690 A1 * 5/2005 Onuma et al. ..... 381/424

FOREIGN PATENT DOCUMENTS

JP 9-224298 8/1997
JP 11-32390 2/1999

* cited by examiner

*Primary Examiner*—Suhan Ni
*Assistant Examiner*—Jasmine Pritchard
(74) *Attorney, Agent, or Firm*—Young & Thompson

(57) ABSTRACT

A speaker device has a connecting member on which a groove capable of accumulating a constant amount of adhesive is formed. The groove is in the vicinity of a lower end of an outer peripheral wall of a cylindrical portion, and is formed on the outer peripheral wall of the cylindrical portion along a circumferential direction. A bottom surface of an inner peripheral edge portion of a conductive damper disposed on an upper side in plural dampers is fixed to the connecting member with adhesive applied to the groove. The adhesive is applied between the upper surface of the inner peripheral edge portion of the conductive damper and the outer peripheral wall of the cylindrical portion. Thus, the conductive damper, which is sandwiched by the adhesive applied to the groove and the adhesive applied to the upper surface of the conductive damper, is fixed to the connecting member.

2 Claims, 8 Drawing Sheets

SPEAKER DEVICE AND METHOD OF MANUFACTURING THE SPEAKER DEVICE

TECHNICAL FIELD

The present invention relates to a supporting structure of a damper in a speaker device.

BACKGROUND ART

Conventionally, there is known an internal magnet type speaker device including a magnetic circuit including a plate-shaped magnet, a planar plate and a pot type yoke, and a vibrating system including a diaphragm, a damper, a connecting member made of a resin material, a voice coil, a voice coil bobbin and a frame.

In such the speaker device, the connecting member is supported by the damper and is mounted to the voice coil bobbin, and movably holds the voice coil bobbin. An inner peripheral edge portion of the damper is mounted to an outer peripheral wall of the connecting member via an adhesive.

However, in the above-mentioned speaker device, the damper is fixed to the connecting member only by the adhesive applied between the outer peripheral wall of the connecting member and the damper itself. Thus, adhesion strength of the damper and the connecting member is small, and bonding strength of the damper and the connecting member is also small. Therefore, at the time of driving the speaker device, the damper easily peels off the connecting member.

There is known a speaker device for improving adhesion strength of a damper and a voice coil (see Japanese Patent Application Laid-Open under No. 9-224298, for example). According to the document, an inner peripheral edge portion of the damper is formed in a taper shape, and an adhesive sump is formed by the taper shape and the voice coil, thereby improving the adhesion strength of the damper and the voice coil.

There is also known a speaker device in which a damper does not peel off even at the time of a large magnitude movement of a vibrating system (see Japanese Patent Application Laid-Open under No. 11-32390, for example). According to the document, a flat portion is formed at an internal diameter portion of the damper, and the flat portion and the lower edge of the voice coil are fixed by the adhesive. Thereby, the adhesion strength of the damper and the voice coil is maintained, and it is prevented that the damper peels off even at the time of the large magnitude movement of the vibrating system.

DISCLOSURE OF THE INVENTION

As an object to be achieved by the present invention, the above described object is cited as an example. The present invention has its object to provide a connecting member capable of improving adhesion strength of a damper and a connecting member in a speaker device.

According to one aspect of the present invention, there is provided a speaker device including: a frame; a damper which has an outer peripheral edge portion supported by the frame; and a connecting member which is mounted to the damper and which movably supports a voice coil bobbin, wherein a groove is formed on an outer peripheral wall of the connecting member along a circumferential direction, and wherein a bottom surface of an inner peripheral edge portion of the damper is fixed to the connecting member via an adhesive applied to an inside of the groove, and an upper surface of the inner peripheral edge portion of the damper is fixed to the connecting member via the adhesive.

In the above-mentioned speaker device, since the groove is formed on the outer peripheral wall of the connecting member along the circumferential direction, the adhesive can be applied to the inside of the groove. In the speaker device, the bottom surface of the inner peripheral edge portion of the damper is fixed to the connecting member via the adhesive applied to the inside of the groove. Moreover, the upper surface of the inner peripheral edge portion of the damper is fixed to the connecting member via the adhesive. Therefore, the damper, which is sandwiched by the adhesive applied to the inside of the groove and the adhesive applied to the upper surface of the damper, is fixed to the connecting member.

Thereby, the adhesion strength of the damper and the connecting member can be improved. Thus, the bonding strength of the damper and the connecting member increases, and the damper hardly peels off the connecting member. In addition, the damper is hardly damaged due to the peeling of the damper. Further, even when a large electric signal is inputted to the voice coil and the voice coil bobbin vibrates with the large magnitude, since the bonding strength of the connecting member and the damper is large, the connecting member can securely support the damper. Thus, the limit value of the withstand input to the voice coil can be set to a high value.

In a preferred example of the above speaker device, an inner peripheral edge portion of another damper which has an outer peripheral edge portion supported by the frame may be fixed to a lower end portion of the outer peripheral wall of the connecting member via the adhesive. Namely, the connecting member is held by the two dampers.

According to another aspect of the present invention, there is provided a method of manufacturing a speaker device including: a process which applies an adhesive to an inside of a groove formed on an outer peripheral wall of a connecting member along a circumferential direction; a process which fixes a bottom surface of an inner peripheral edge portion of a damper to the connecting member via the adhesive applied to the inside of the groove; and a process which fixes an upper surface of the inner peripheral edge portion of the damper to the connecting member by applying the adhesive to the upper surface of the inner peripheral edge portion of the damper and the outer peripheral wall of the connecting member.

In the above-mentioned method of manufacturing the speaker device, first, the adhesive is applied to the inside of the groove formed on the outer peripheral wall of the connecting member along the circumferential direction. Next, by the adhesive applied to the inside of the groove, the bottom surface of the inner peripheral edge portion of the damper is fixed to the connecting member. Next, the adhesive is applied between the upper surface of the inner peripheral edge portion of the damper and the outer peripheral wall of the connecting member, and the upper surface of the inner peripheral edge portion of the damper is fixed to the connecting member. In the speaker device thus manufactured, the damper, which is sandwiched by the adhesive applied to the inside of the groove and the adhesive applied to the upper surface of the damper, is fixed to the connecting member. Thus, the adhesion strength of the damper and the connecting member can be improved. The bonding strength of the damper and the connecting member increases, and the damper hardly peels off the connecting member. In addition, the damper is hardly damaged due to the peeling of the damper. Further, even when the voice coil bobbin vibrates with the large magnitude, since the connecting member can securely support the damper, the limit value of the withstand input to the voice coil can be set to the high value.

BEST MODE FOR CARRYING OUT THE INVENTION

A preferred embodiment of the present invention will be explained hereinafter with reference to the drawings. In this embodiment, a groove in a recessed shape capable of accumulating a constant amount of adhesive is formed at the outer peripheral edge portion of the connecting member. By applying (filling) the adhesive to the inside of the groove, the bottom surface of the inner peripheral edge portion of the conductive damper disposed on the upper side in the plural dampers and the connecting member are fixed to each other. Moreover, the adhesive is applied between the upper surface of the inner peripheral edge portion of the conductive damper and the outer peripheral wall of the connecting member. Thereby, improving of the adhesion strength of the conductive damper and the connecting damper is attempted.

Figure 1:
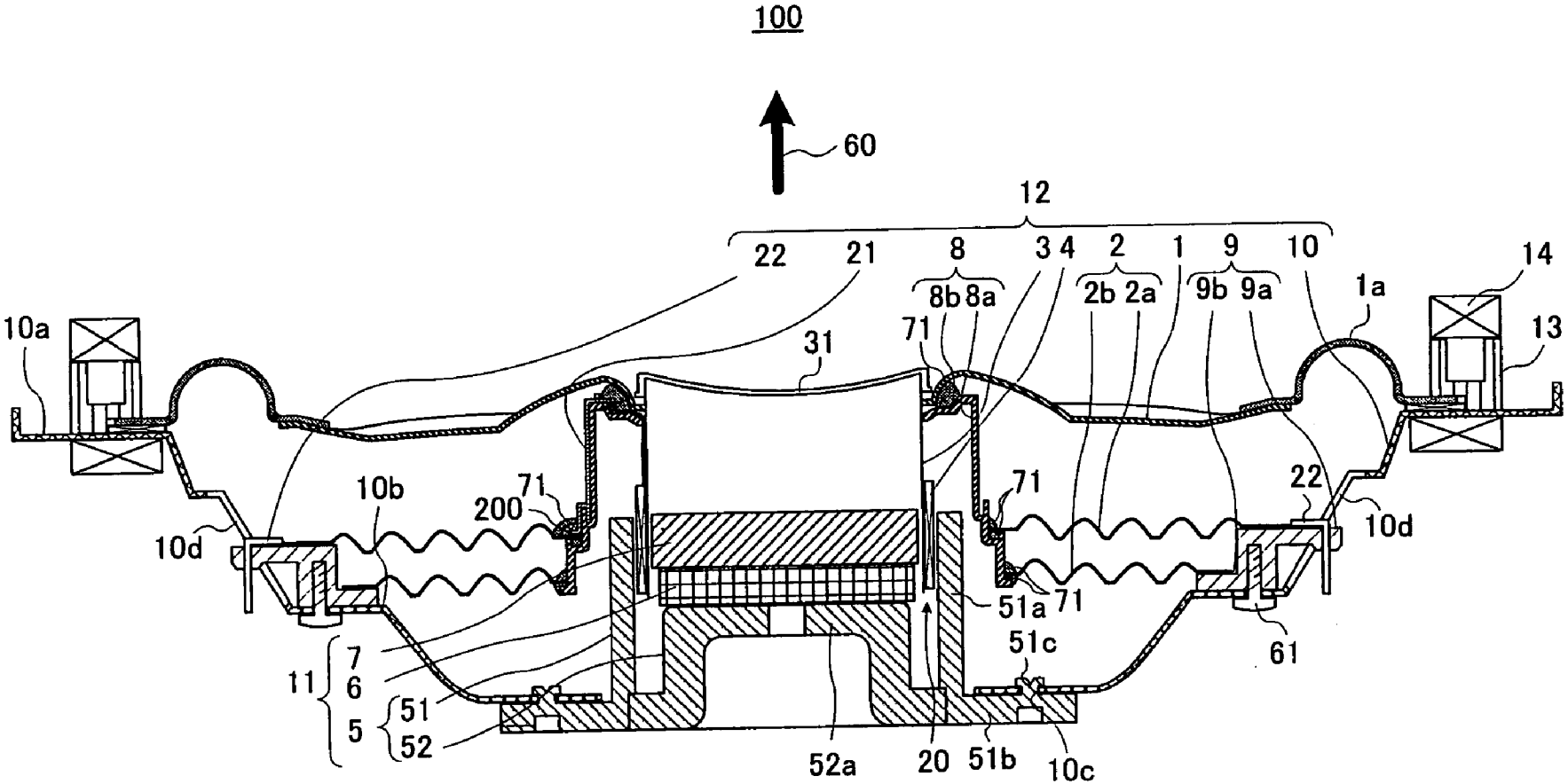
FIG. 1 shows a sectional view of a speaker device according to an embodiment of the present invention.

A general construction of a speaker device 100 according to the embodiment of the present invention will be schematically shown in FIG. 1. The speaker device 100 of this embodiment can be preferably used as an on-vehicle speaker. FIG. 1 shows a sectional view when cutting the speaker device 100 by a plane including a central axis thereof. A construction and the like of the speaker device 100 of this embodiment will be explained hereinafter with reference to FIG. 1.

As shown in FIG. 1, the speaker device 100 mainly includes a vibrating system 12 having a frame 10, a support member 9, a voice coil bobbin 3, a connecting member 8, a damper 2, terminal members 21, terminal members 22, a voice coil 4 and a diaphragm 1, a magnetic circuit system 11 having a pot type yoke 5, a magnet 6 and a plate 7, an anti-dust cap 31, and other various kinds of members.

First, each component of the vibrating system 12 will be explained.

Various components of the speaker device 100 are fixed to the frame 10, and the frame 10 has the function of supporting these components. The frame 10 is made of a metal material of good thermal conductivity. Therefore, the frame 10 has the function as a medium for giving and receiving heat to and from an external space of the speaker device 100 and its internal space. The frame 10 is formed into a pan-shape or pot-shape which is opened upward, and has a first flange part 10*a* formed at the top part for supporting an outer peripheral edge portion and the like of the diaphragm 1, a second flange part 10*b* formed at an intermediate part for supporting the support member 9, openings 10*c* formed in an inner peripheral edge portion, and a plurality of openings 10*d* formed at a side wall between the first flange part 10*a* and the second flange part 10*b*. A plurality of openings 10*c* are formed with fixed spaces therebetween in a circumferential direction of the inner peripheral edge portion. Each of the projecting portions 51*c* of the pot type yoke 5 before deformation, which will be described later, is inserted into each of the openings 10*c*.

The support member 9 is formed of, for example, a resin material, and is formed into a substantially annular shape in the plane view. The support member 9 is formed into a step shape in the sectional view, and has a top surface 9*a* and a top surface 9*b*. The support member 9 is mounted to the second flange part 10*b* by a fixing member 61 such as a male screw and a bolt.

The voice coil bobbin 3 is formed into a substantially cylindrical shape. The voice coil 4 is wound around an outer peripheral wall of a lower end portion of the voice coil bobbin 3. The inner peripheral wall of the lower end portion of the voice coil bobbin 3 is opposed to outer peripheral walls of the planar magnet 6 and plate 7 with a fixed space from them. The outer peripheral wall of the lower end portion of the voice coil bobbin 3 is opposed to an outer peripheral wall of an upper end portion of a pole piece 5 at a fixed space from it. A clearance (magnetic gap 20) is formed between an inner peripheral wall of the upper end portion of the pole piece 5 and an outer peripheral wall of the plate 7.

The connecting member 8 is formed of, for example, a resin material, has a cylindrical portion 8*a* formed into a substantially cylindrical shape and a bent portion 8*b* formed in a fashion being bent inwardly from an upper end of the cylindrical portion 8*a*, and is made by integrally forming them. An inner peripheral edge portion of the connecting member 8, namely, an inner peripheral edge portion of the bent portion 8*b* is fixed to an area in the vicinity of the upper end of the outer peripheral wall of the voice coil bobbin 3. The configuration of the connecting member 8, which is a characteristic of the present invention, will be explained later.

The damper 2 has a conductive damper 2*a* and an ordinary damper 2*b*. The conductive damper 2*a* is disposed above the damper 2*b*. The conductive damper 2*a* has a plurality of conductive members not shown. Each of the conductive members is sewn onto a top surface of the conductive damper 2*a* from the inner peripheral edge portion of the conductive damper 2*a* to its outer peripheral edge portion. The outer peripheral edge portion of the damper 2*b* is fixed to the top surface 9*b* of the support member 9 and the inner peripheral edge portion of the damper 2*b* is fixed to a lower end portion of the connecting member 8 via adhesive 71. Meanwhile, the outer peripheral edge portion of the conductive damper 2*a* is fixed to the top surface 9*a* of the support member 9 and the inner peripheral edge portion of the conductive damper 2*a* is fixed to an area in the vicinity of the lower end of the connecting member 8 via the adhesive 71.

The terminal member 21 is a member having conductivity, and a plurality of terminal members 21 are provided. Each terminal member 21 is mounted to the connecting member 8. The upper end of each of the terminal members 21 is electrically connected to each lead wire of the voice coil 4, and a lower end of each of the terminal members 21 is electrically connected to each of the conductive members of the conductive damper 2*a*.

The terminal member 22 is a member having conductivity, such as metal, and a plurality of terminal members 22 are provided. Each of the terminal members 22 is fixed to the top surface 9*a* of the support member 9. One end of each of the terminal members 22 is electrically connected to each of the conductive members of the conductive damper 2*a*, and the other end of each of the terminal members 22 is electrically connected to a relay wiring at an amplifier side not shown.

The voice coil 4 has a pair of positive/negative lead wires (not shown). A lead wire at the positive side is an input wiring for an L (or R) channel signal, and a lead wire at the negative side is an input wiring for a ground (GND: ground) signal. Each lead wire is electrically connected to the upper end of each of the terminal members 21 as described above. Therefore, an electric signal of one channel is inputted from the amplifier side into the voice coil 4 via each of the terminal members 22, each of the conductive members of the conductive damper 2*a*, each of the terminal members 21 and each of the lead wires.

The diaphragm 1 is formed into a substantially planer shape to be made thin. Various kinds of materials such as paper, polymer, and metal can be applied to the diaphragm 1 in accordance of the various kinds of use purposes. The edge portion 1*a* which is a separate piece from the diaphragm 1 is mounted to an outer peripheral edge portion of the diaphragm 1. The outer peripheral edge portion of the diaphragm 1 is fixed to the first flange part 10*a*. Meanwhile, an inner peripheral edge portion of the diaphragm 1 is fixed to the area in the vicinity of the upper end of the outer peripheral wall of the voice coil bobbin 3. The inner peripheral edge portion of the diaphragm 1 and the bent portion 8*b* of the connecting member 8 are fixed via the adhesive 71.

Next, each component of the magnetic circuit 11 will be explained.

The magnetic circuit system 11 is constructed as the internal magnet type magnetic circuit. This magnetic circuit has the pot type yoke 5, the planar magnet 6 and the planar plate 7. The pot type yoke 5 has a body part 51 and a bottom part 52, and they are bonded together. The pot type yoke 5 is mounted on frame 10.

The body part 51 has a cylindrical portion 51*a*, a flange part 51*b*, and projecting portions 51*c* projecting upward from the top surface of the flange part 51*b*, and is formed by integrating them. The cylindrical portion 51*a* is formed into a substantially cylindrical shape. The cylindrical portion 51*a* extends upward from the area in the vicinity of the inner circumference of the flange part 51*b* to the position in the vicinity of the plate 7. The flange part 51*b* extends in the outward direction substantially perpendicularly from the position in the vicinity of the lower end of the outer peripheral wall of the cylindrical portion 51*a*. The inner peripheral edge portion of the frame 10 is mounted to the top surface of the flange part 51*b*. The projecting portion 51*c* is formed into the columnar shape and a plurality of projecting portions 51*c* are formed on the top surface of the flange part 51*b* with fixed spaces from each other. Each of the projecting portions 51*c* has the function of fixing the inner peripheral edge portion of the frame 10 by being caulked.

The bottom part 52 has the sectional shape of substantially inversed recessed shape. The bottom part 52 has a mounting portion 52*a* whose size is substantially the same as the diameters of the planer magnet 6 and the planar plate 7. The outer peripheral edge portion of the bottom part 52 is connected to the body part 51.

The planar magnet 6 is fixed onto the mounting portion 52*a* of the bottom part 52 of the pot type yoke 5. The planar plate 7 is fixed onto the magnet 6. In the magnetic circuit system 11, the magnetic circuit is constructed by the magnet 6 and the plate 7, and magnetic flux of the magnet 6 is concentrated at the magnetic gap 20 formed between the outer peripheral wall of the plate 7 and the inner peripheral wall of the pot type yoke 5.

The anti-dust cap 31 is mounted to the upper end portion of the voice coil bobbin 3 via the adhesive so as to close the top surface of the voice coil bobbin 3. Thereby, the anti-dust cap 31 has the function of preventing a foreign matter or the like from entering the inside of the speaker device 100.

Next, various kinds of component members will be explained.

Various kinds of component members include a packing 13, a buffer member 14 and the like.

The packing 13 is formed into an annular shape and is the member having insulating property. As the material for the packing 13, for example, a resin material is preferable. The bottom surface of the packing 13 is fixed to the first flange part 10*a* and the outer peripheral edge part of the edge portion 1*a*. Thereby, the outer peripheral edge part of the diaphragm 1 and the edge portion 1*a* is sandwiched by the packing 13 and the first flange part 10*a*.

The buffer member 14 has the function as the buffer material when the speaker device 100 is mounted to a predetermined position of the vehicle, for example, and has the function and the like of preventing the vibration from the outside from being transmitted to the body of the speaker device 100. Therefore, as the material of the buffer member 14, for example, a member having cushioning property such as sponge is preferable. The buffer member 14 has a rod shape before being mounted, and an adhesive is applied to one side surface, or a double-side adhesive tape is attached to one side surface. The buffer member 14 is attached on the upper surface of the packing 13 via the adhesive or the double-side adhesive tape in the state in which it is deformed in an annular shape.

In the speaker device 100 which is described above, an electric signal outputted from the amplifier is supplied to the voice coil 4 via each of the terminal members 22, each of the conductive members of the conductive damper 2*a*, each of the terminal members 21 and each lead wire of the voice coil 4. Thereby, driving force occurs to the voice coil 4 in the magnetic gap 20, and vibrates the diaphragm 1 in the axial direction of the speaker device 100. Thus, the speaker device 100 emits acoustic waves in the direction of the arrow 60.

[Supporting Structure of Conductive Damper and Connecting Member]

Figure 2:
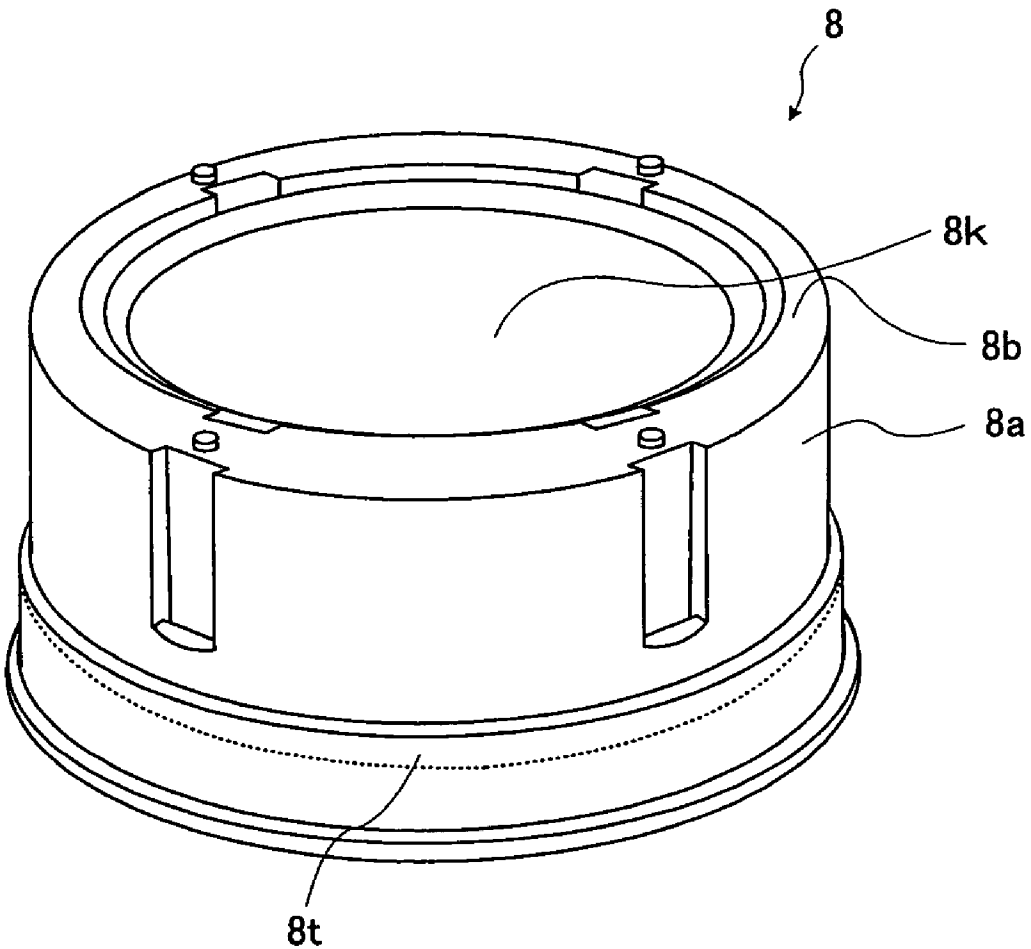
FIG. 2 shows a perspective view of a connecting member according to a present embodiment.
Figure 3A:
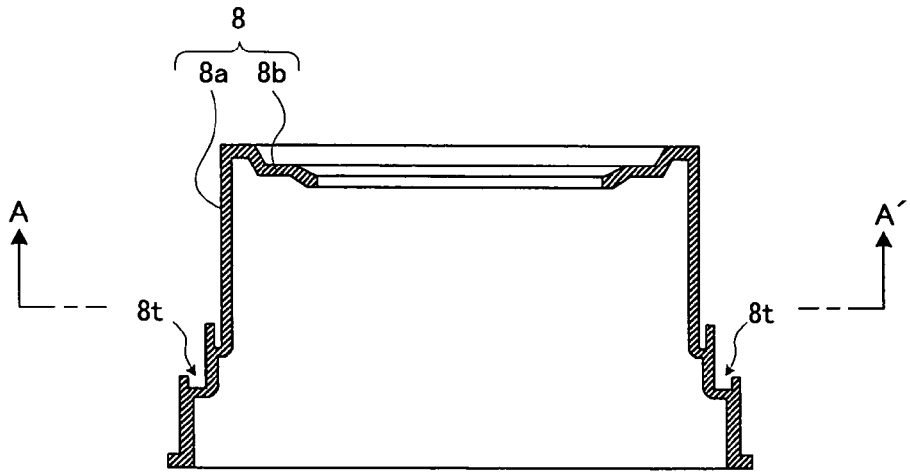
FIG. 3A shows a sectional view of the connecting member according to this embodiment.
Figure 3B:
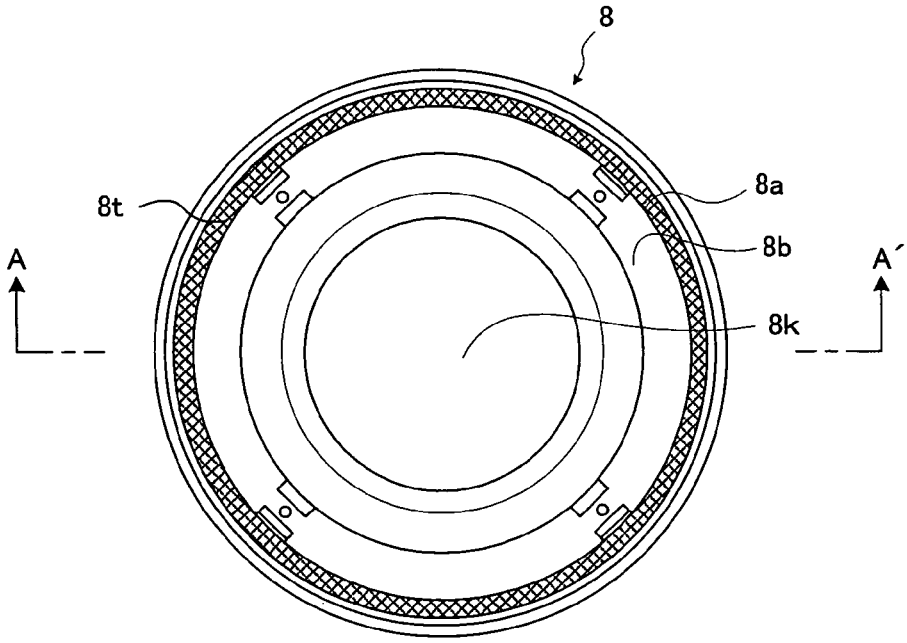
FIG. 3B shows a plan view thereof.
Figure 4:
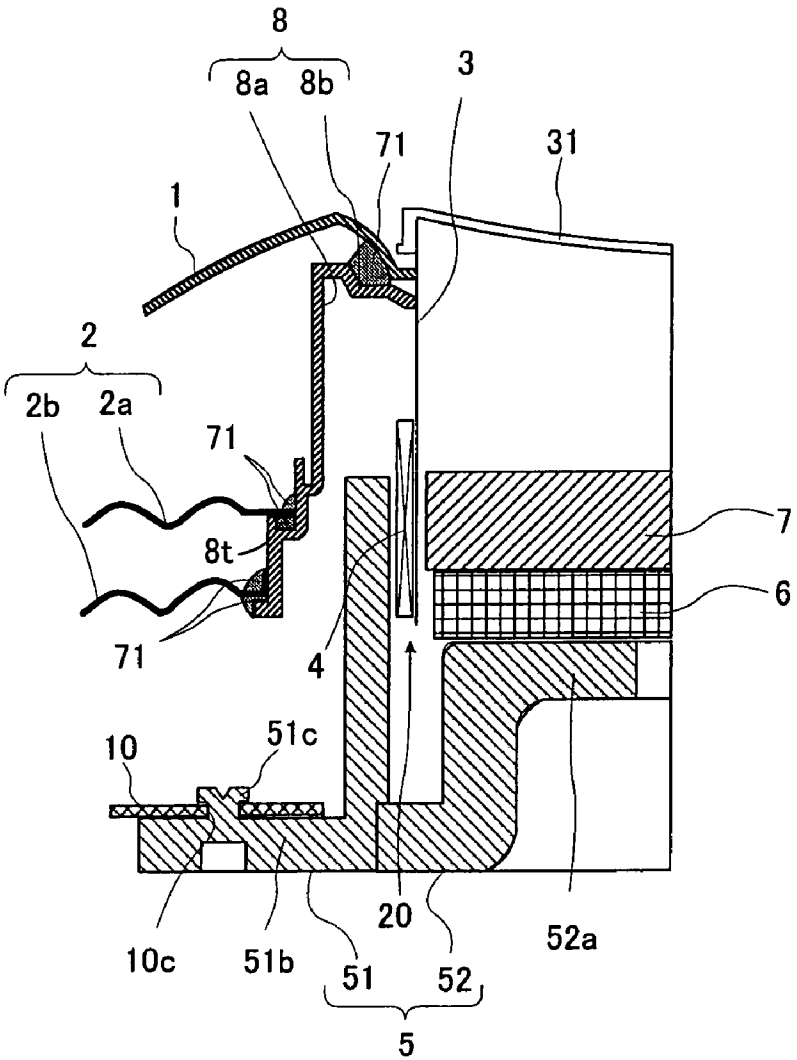
FIG. 4 is a sectional view of a local part showing a supporting structure of a conductive damper of this embodiment.

Next, the description will be given of a structure of the connecting member 8 capable of improving the adhesion strength of the connecting member 8 and the damper disposed on the upper side in the plural dampers 2, i.e., the conductive damper 2*a*, with reference to FIG. 2 to FIG. 4. FIG. 2 shows a perspective view of the connecting member 8, which is a characteristic of the present invention. FIG. 3B shows a plan view of the connecting member 8. FIG. 3A is a sectional view of the connecting member 8 shown in FIG. 3B, taken along the cutting-plane line A-A'. FIG. 4 shows a sectional view of the local part of the speaker device 100, and particularly shows a state that the conductive damper 2*a* and the connecting member 8 are fixed to each other via the adhesive 71.

The basic structure of the connecting member 8 is described above. Particularly, the connecting member 8, which is the characteristic of the present invention, has a groove 8*t* capable of accumulating the constant amount of adhesive 71. The groove 8*t* has a function, together with the adhesive 71 filled in the groove 8*t*, of fixing the bottom surface of the inner peripheral edge portion of the conductive damper 2*a*. The groove 8*t* is formed at the position in the vicinity of the lower end lower than the center of the outer peripheral wall of the cylindrical portion 8*a*, and is formed on the outer peripheral wall of the cylindrical portion 8*a* along the circumferential direction. The bottom surface of the inner peripheral edge portion of the conductive damper 2*a* is fixed to the connecting member 8 by the adhesive 71 applied to the inside of the groove 8*t*. The adhesive 71 is applied between the upper surface of the inner peripheral edge portion of the conductive damper 2*a* and the outer peripheral wall of the cylindrical portion 8*a*, and the upper surface of the inner peripheral edge portion of the conductive damper 2*a* and the outer peripheral wall of the cylindrical portion 8*a* are fixed to each other. Therefore, the conductive damper 2*a*, which is sandwiched by the adhesive 71 applied to the inside of the groove 8*t* and the adhesive 71 applied to the upper surface of the conductive damper 2*a*, is fixed to the connecting member 8.

Thereby, the adhesion strength of the conductive damper 2*a* and the connecting member 8 can be improved. Thus, the bonding strength of the conductive damper 2*a* and the connecting member 8 increases, and the conductive damper 2*a* hardly peels off the connecting member 8. In addition, the conductive damper 2*a* is hardly damaged due to the peeling of the conductive damper 2*a*. Moreover, even when the large electric signal is inputted to the voice coil 4 and the voice coil bobbin 3 vibrates with the large magnitude, since the bonding strength of the connecting member 8 and the conductive damper 2*a* is large, the connecting member 8 can securely support the conductive damper 2*a*. Therefore, the limit value of the withstand input to the voice coil 4 can be set to the high value.

[Method of Manufacturing Speaker Device 100]

Figure 5:
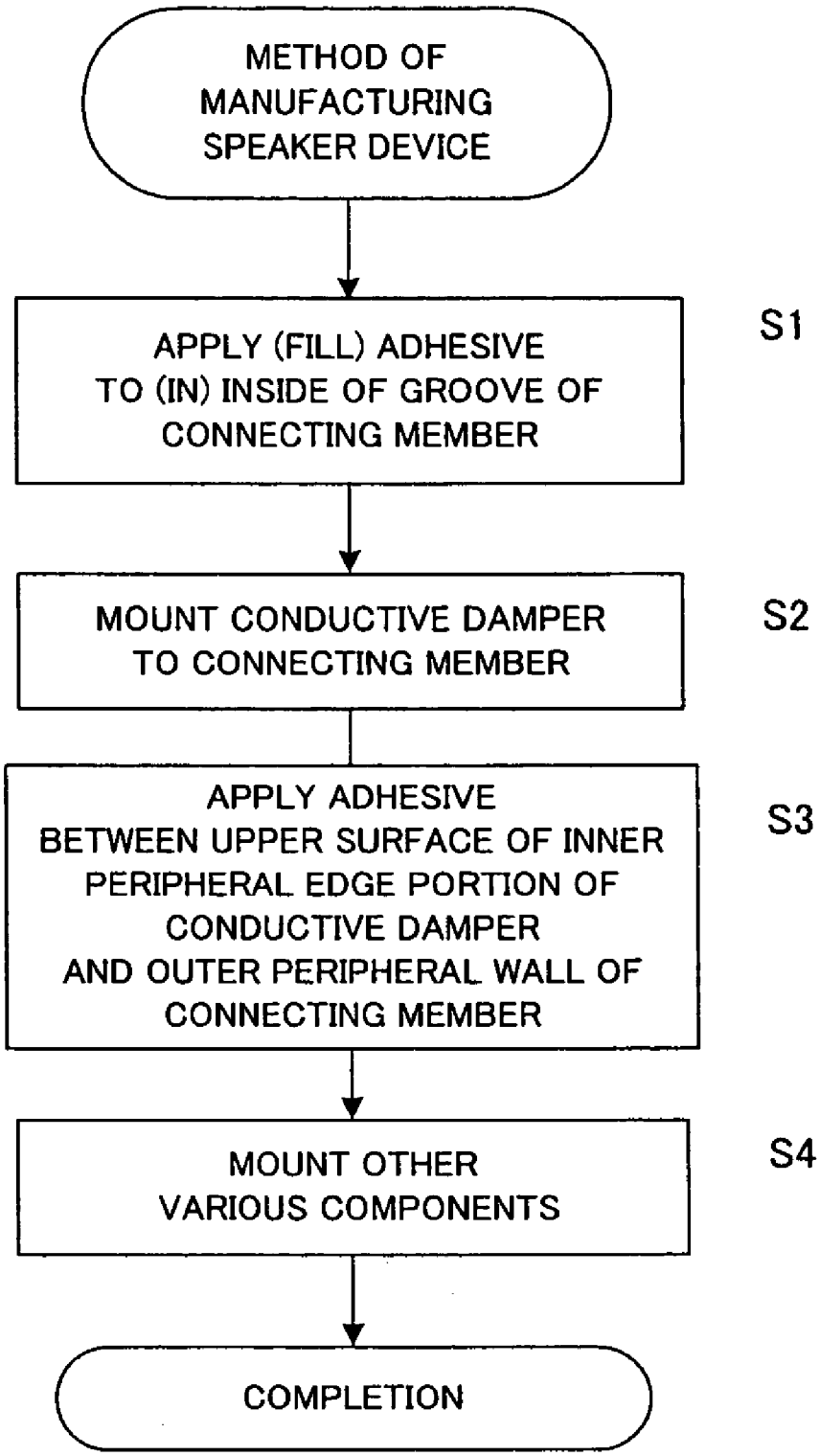
FIG. 5 shows a flow chart of a method of manufacturing the speaker device according to this embodiment.
Figure 6:
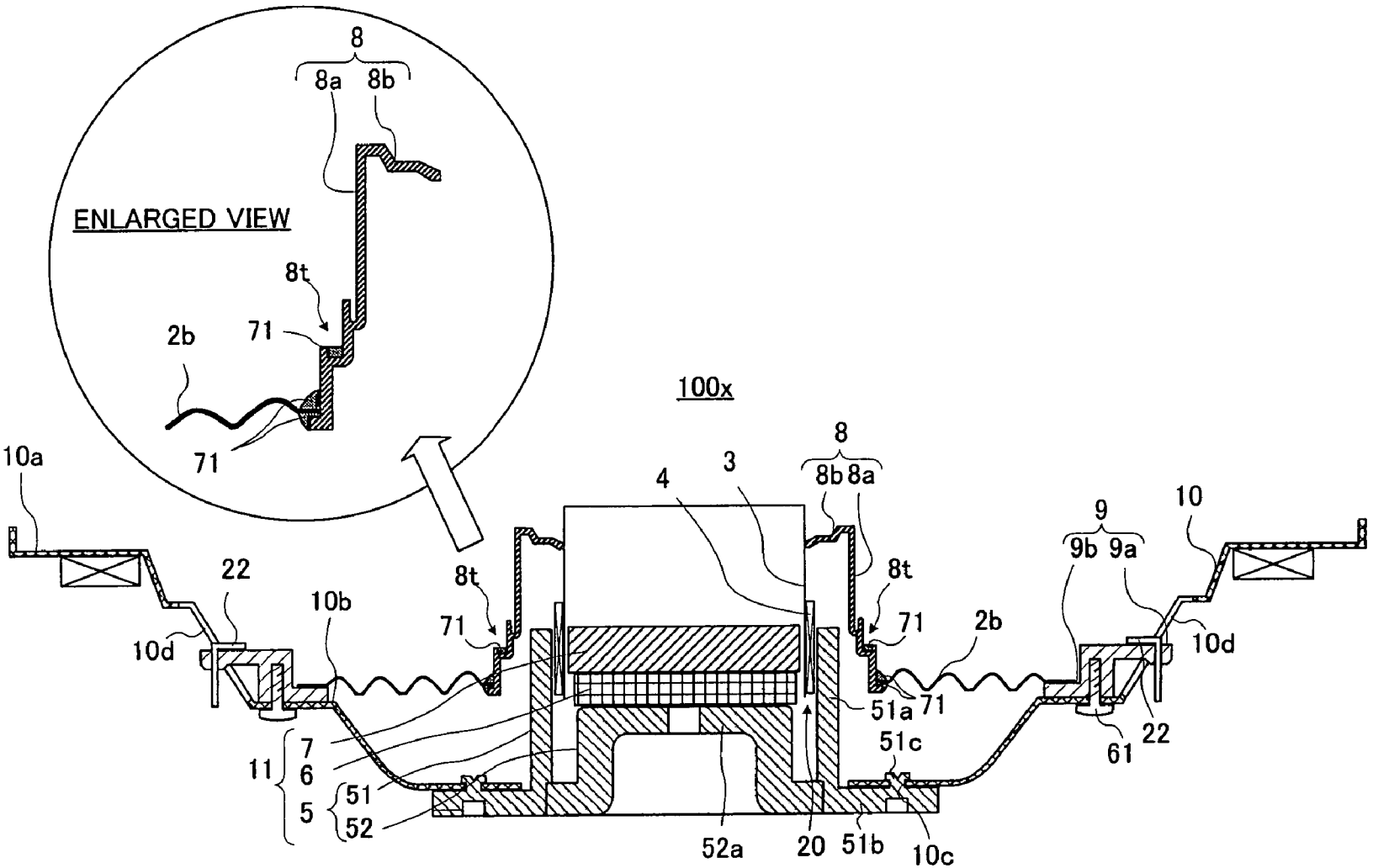
FIG. 6 shows a sectional view of a process of manufacturing the speaker device.
Figure 7:
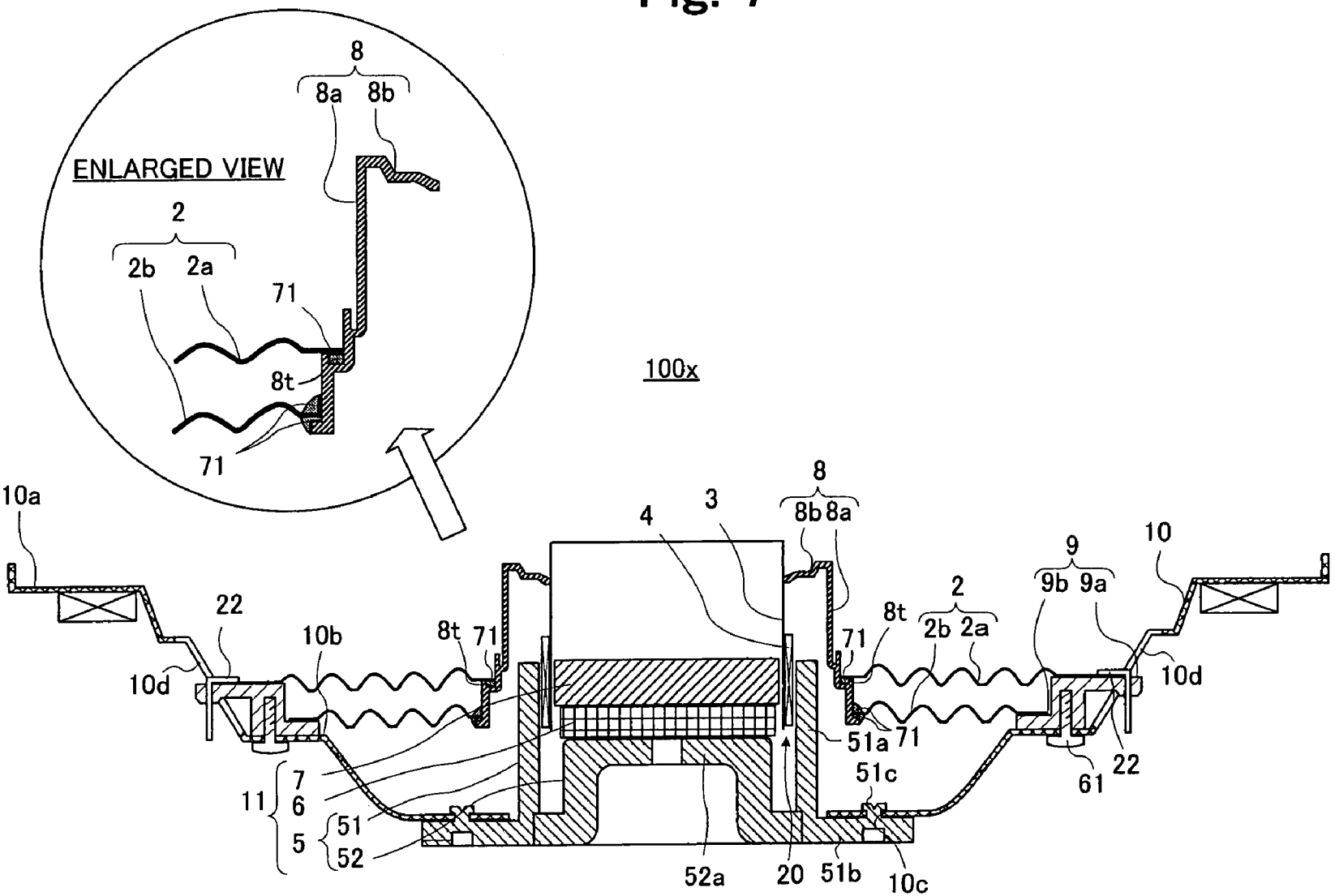
FIG. 7 shows a sectional view of a process of manufacturing the speaker device.
Figure 8:
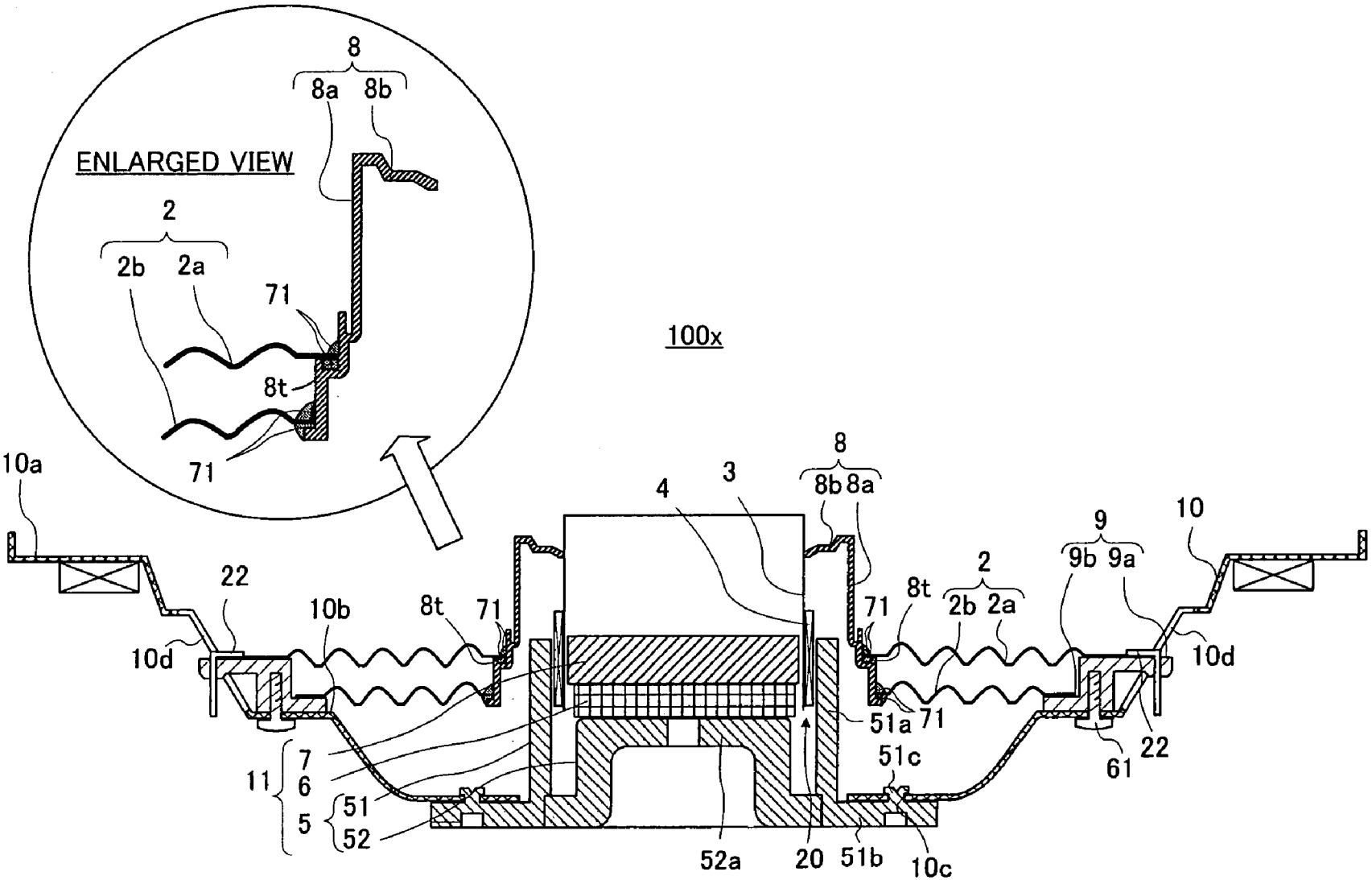
FIG. 8 shows a sectional view of a process of manufacturing the speaker device.

Next, the description will be given of a method of manufacturing the speaker device 100 with reference to FIG. 5 to FIG. 8. FIG. 5 shows a flow chart of the method of manufacturing the speaker device 100. FIG. 6 to FIG. 8 show respective sectional views of processes of manufacturing the speaker device 100, which are correspondent to the flow chat of FIG. 5.

First, the adhesive 71 is applied to (filled in) the inside of the groove 8*t* of the connecting member 8 (step S1). Concretely, as shown in FIG. 6, in a semi-manufactured speaker unit 100*x* on which the terminal member 21, the diaphragm 1, the packing 13 and the buffer member 14 are not mounted, the adhesive 71 is applied to (filled in) the inside of the groove 8*t* of the connecting member 8.

Next, the conductive damper 2*a* is mounted to the connecting member 8 (step S2). Concretely, as shown in FIG. 7, the bottom surface of the inner peripheral edge portion of the conductive damper 2*a* is disposed on the groove 8*t*, and the bottom surface of the inner peripheral edge portion of the conductive damper 2*a* and the connecting member 8 are fixed via the adhesive 71 applied to the groove 8*t*. The bottom surface of the outer peripheral edge portion of the conductive damper 2*a* and the upper surface 9*a* of the support member 9 are fixed via the adhesive 71.

Next, as shown in FIG. 8, the adhesive 71 is applied between the upper surface of the inner peripheral edge portion of the conductive damper 2*a* and the outer peripheral wall of the connecting member 8 (step S3). A constant time period passes, and the adhesive 71 is completely dried. The inner peripheral edge portion of the conductive damper 2*a* is fixed to the connecting member 8. The conductive damper 2*a*, which is sandwiched by the adhesive 71 applied to the inside of the groove 8*t* and the adhesive 71 applied to the upper surface of the conductive damper 2*a*, is fixed to the connecting member 8. Thereby, the adhesion strength of the conductive damper 2*a* and the connecting member 8 can be improved. Thus, the bonding strength of the conductive damper 2*a* and the connecting member 8 increases, and the conductive damper 2*a* hardly peels off the connecting member 8. In addition, the conductive damper 2*a* is hardly damaged due to the peeling of the conductive damper 2*a*.

Next, other various components are mounted, and the speaker device 100 is manufactured (step S4). Concretely, the terminal member 21, the diaphragm 1, the packing 13 and the buffer member 14 are mounted on the speaker unit 100*x* in which the conductive damper 2*a* is mounted to the connecting member 8. In this way, the speaker device 100 shown in FIG. 1 is manufactured.

What is claimed is:

1. A speaker device comprising:

a frame;

a diaphragm;

two dampers each of which has an outer peripheral edge portion supported by the frame; and a connecting member which is connected to the two dampers and which is fixed to a voice coil bobbin, wherein the connecting member has two cylindrical parts each having a different diameter, wherein a groove and a flange part are formed, respectively, on an outer peripheral wall of the connecting member along a circumferential direction, and wherein a bottom surface of an inner peripheral edge portion of one of the two dampers is fixed to the connecting member via an adhesive applied to an inside of the groove, and an upper surface of the inner peripheral edge portion of the one of the two dampers is fixed to the connecting member via the adhesive.

2. The speaker device according to claim 1, wherein an inner peripheral edge portion of another one of the two dampers is fixed to the flange part of the connecting member.

* * * * *